US008418809B2

(12) United States Patent
Donlon

(10) Patent No.: US 8,418,809 B2
(45) Date of Patent: Apr. 16, 2013

(54) HUNTING LADDER ANCHOR

(76) Inventor: Kevin Louis Donlon, De Pere, WI (US)

( * ) Notice: Subject to any disclaimer, the term of this patent is extended or adjusted under 35 U.S.C. 154(b) by 290 days.

(21) Appl. No.: 12/894,099

(22) Filed: Sep. 29, 2010

(65) Prior Publication Data

US 2011/0100752 A1 May 5, 2011

Related U.S. Application Data

(60) Provisional application No. 61/256,947, filed on Oct. 31, 2009.

(51) Int. Cl.
*E06C 7/42* (2006.01)

(52) U.S. Cl.
USPC ..... 182/111

(58) Field of Classification Search ..... 182/107, 182/108, 109, 111, 203, 204
See application file for complete search history.

(56) References Cited

U.S. PATENT DOCUMENTS

| | | | | | |
|---|---|---|---|---|---|
| 776,446 | A * | 11/1904 | Williamson | ..... | 182/107 |
| 1,543,723 | A * | 6/1925 | Rivitz | ..... | 182/109 |
| 2,371,460 | A * | 3/1945 | Needham | ..... | 182/204 |
| 4,607,726 | A * | 8/1986 | Davis et al. | ..... | 182/204 |
| 4,683,980 | A * | 8/1987 | Vayko | ..... | 182/108 |
| 5,476,153 | A * | 12/1995 | Dickerson et al. | ..... | 182/204 |
| 5,669,462 | A * | 9/1997 | Jennings | ..... | 182/111 |
| 5,788,204 | A * | 8/1998 | Goodwin et al. | ..... | 248/357 |
| 5,913,382 | A * | 6/1999 | Martin | ..... | 182/204 |
| 2008/0011549 | A1 | 1/2008 | Lott | | |

* cited by examiner

*Primary Examiner* — Katherine Mitchell
*Assistant Examiner* — Kristine Florio
(74) *Attorney, Agent, or Firm* — Steven H Greenfield; Greenfield Invention and Patent Consulting Inc.

(57) ABSTRACT

A device for anchoring a ladder to the ground and a method for setting up a ladder against a standing object is disclosed. The device comprises of two anchoring members, each having a brace member configured for containing and securing one of the ladder legs, adapted for engaging with the ground and adapted for pivoting from a front side to a back side of the anchoring members. In another embodiment, each of the brace members is configured for containing the bottom rung of a ladder for situations where the legs cannot be secured by the brace member. The method for setting up a ladder against a standing object such as a tree comprises of bracing the legs or the bottom rung by the brace members and anchoring the device to the ground while the ladder is laying flat on the ground, then raising the ladder toward the standing object.

7 Claims, 11 Drawing Sheets

FIG. 3
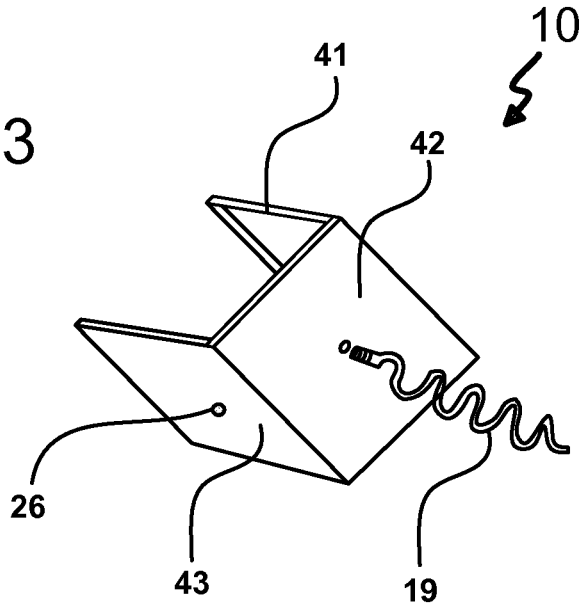
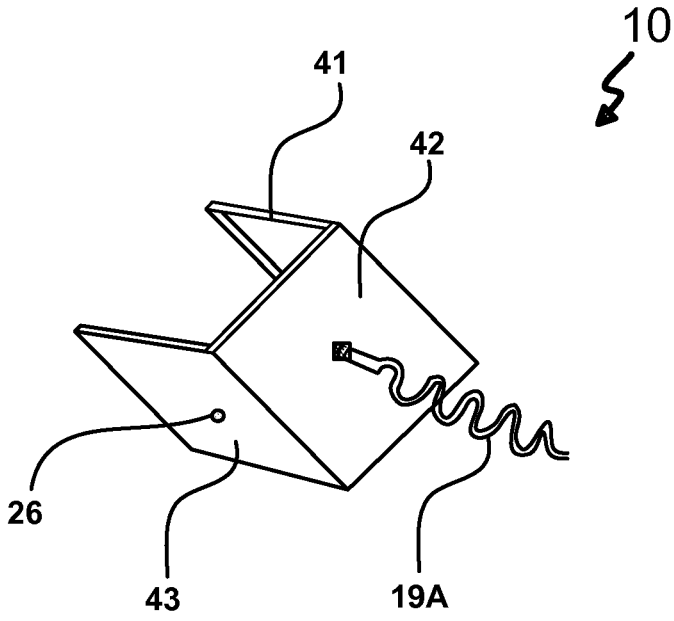
FIG. 3A

FIG 5A
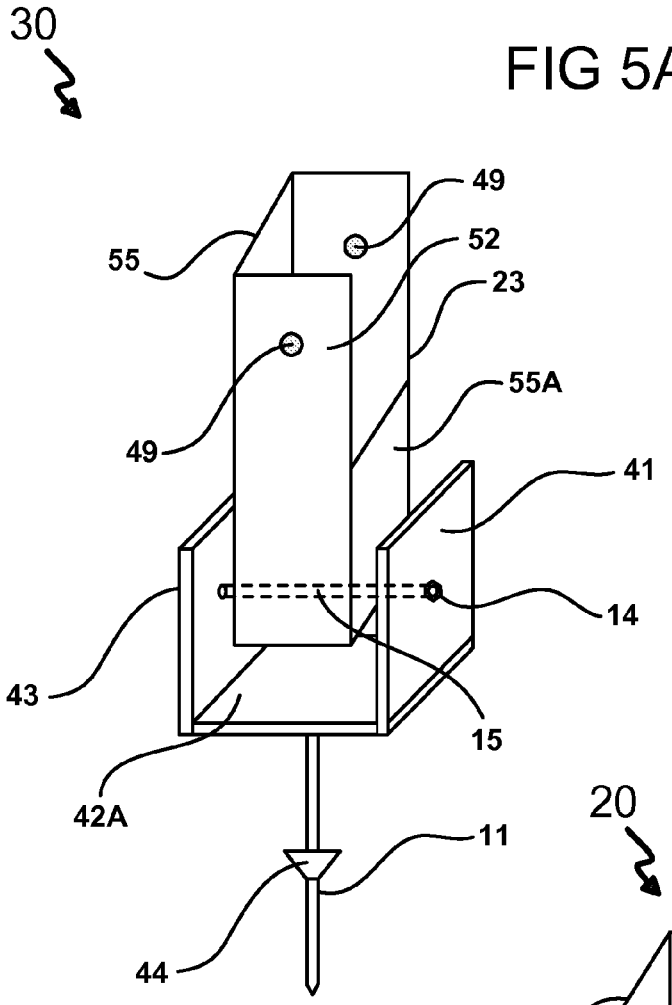
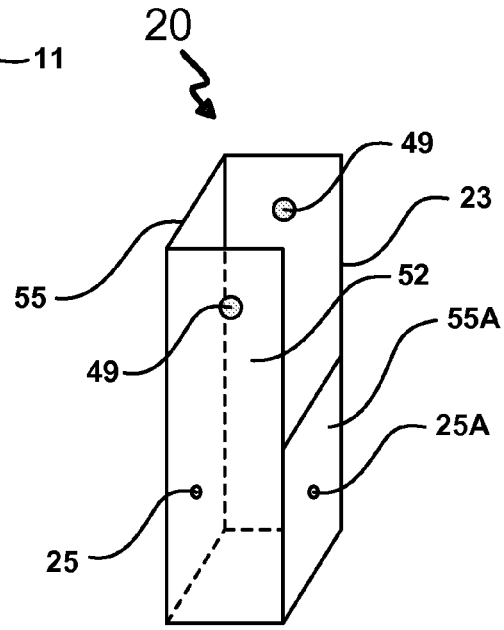
FIG 5

HUNTING LADDER ANCHOR

RELATED APPLICATIONS

This application claims priority from provisional application No. 61/256,947 filed on Oct. 31, 2009.

FIELD OF THE INVENTION

The present invention relates to a device for supporting a ladder while raising it and leaning it against a wall or a tree and for keeping the ladder in a secure position on the ground. More specifically, the present invention discloses a device for supporting a ladder used for hunting that contains a stand at the top and is leaned against a tree.

DESCRIPTION OF RELATED ART

Hunting ladders are typically long and contain a stand where a hunter may be stationed while waiting for an animal to appear. This type of ladder is typically leaned against a tree onto which the hunter climbs and where he or she may be camouflaged. To set up such ladders against a tree, they must be lifted from a flat position on the ground to an erect position. Part of the difficulty in accomplishing this pertains to the problem of maintaining the base of the ladder base or legs in a fixed position while the hunter lifts the ladder and leans it against the tree. Even after the ladder has been set up, the legs of a ladder may slip or move thus endangering the hunter unless the legs are maintained in that fixed position. It would be therefore desirable to securely anchor the legs of the ladder in order to lift the ladder against the tree and keep it in a stable position when in use.

US Pre-grant publication number 20080011549 discloses a system for erecting a ladder stand for hunting has a pivoting base assembly connected to a bottom end of a ladder, and a pair of support legs pivotally attached to respective sides of an upper section of the ladder. The pivoting base assembly includes first and second foot pad members, anchoring posts for anchoring the foot pad members to the ground, a base frame pivotally connected to the foot pad members, and first and second receiver tubes connected to the base frame for receiving the bottom end of the ladder. The pivoting base assembly receives and anchors the bottom end of the ladder and allows the ladder to be easily moved from a horizontal position to an upright position. The support legs have ground pegs at their lower ends for engaging the ground to support the ladder stand in an intermediate position as the ladder stand is being erected.

This device does not seem to accommodate ladders that have low rungs and its construction appears cumbersome to use. As can be seen, a need exists for an easy to use device that can accommodate different style and size ladders.

SUMMARY OF THE PRESENT INVENTION

In one aspect of the present invention, a device for anchoring a ladder onto a ground surface comprising a first anchoring member having a front side and a back side and a second anchoring member having a front side and a back side, the ladder having a first leg and a second leg, with each of the first and second anchoring member comprises: a channel bracket having a bottom, a first sidewall and a second sidewall, the bottom having an undersurface and an oversurface; a ground-engaging member having a first end, a second end and a length portion, the first end of the ground-engaging member being attached to the bottom of the channel bracket, the second end and the length portion being adapted for engagement with the ground; a pivot rod having a first end and a second end, the first end being affixed to a spot on the first side of the channel bracket and the second end being affixed to the second side of the channel bracket; and a brace member having a first sidewall, a second sidewall, an open bottom, a front wall and a back wall, the pivot rod being threaded though an opening in the first sidewall and an opening in the second sidewall in a manner that the pivot rod supports the brace member and in a manner that the brace member is adapted for pivoting around the pivot rod in a direction from the front side of the anchoring member toward the back side of the anchoring member and vice versa.

In another aspect of the present invention, a device for anchoring a ladder onto a ground surface comprising a first anchoring member having a front side and a back side and a second anchoring member having a front side and a back side, the ladder having a first rung, the ladder also having a first vertical side attached to a side of the first rung and a second vertical side attached to another side of first rung, with each of the first and second anchoring member comprises: a channel bracket having a bottom, a first side and a second side, the bottom having an undersurface and an oversurface; a ground-engaging member having a first end, a second end and a length portion, the first end of the ground-engaging member being attached to the bottom of the channel bracket, the second end and the length portion being adapted for engagement with the ground; a pivot rod having a first end and a second end, the first end being affixed to a spot on the first side of the channel bracket and the second end being affixed to the second side of the channel bracket; a brace member having a first sidewall, a second sidewall, an open bottom, a front wall and a back wall, the pivot rod being threaded though an opening in the first sidewall and an opening in the second sidewall in a manner that the pivot rod supports the brace member and in a manner that the brace member is adapted for pivoting around the pivot rod in a direction from the front side of the anchoring member toward the back side of the anchoring member and vice versa, the brace member being adapted for supporting a first rung of a ladder; a lateral extension tab attached to an upper portion of the brace member front wall; and a lateral extension tab attached to an upper portion of the brace member back wall.

In yet another aspect of the present invention, a method for setting up a ladder against a standing object, using a device comprising a first anchoring member and a second anchoring member, with each anchoring member containing a channel bracket, a ground-engaging member and a brace member, the brace member being pivotally attached to the channel bracket, the brace member being adapted to pivot from a front position to a rear position, the ladder having a first leg, a second leg and a top side, the method comprises: pre-selecting a ground location for anchoring the first leg and the second leg of the ladder; setting up the ladder in a flat position on the ground, the legs being positioned about the respective preselected ground locations for anchoring the first leg and the second leg of the ladder, the top of the ladder being situated away from the standing object; with the brace member of the first anchoring member situated about vertically relative to the ground-engaging member of the first anchoring member and about horizontally relative to the ground, positioning the first anchoring member in a manner that a bottom portion of the first leg of the ladder is disposed inside the brace member of the first anchoring member; with the brace member of the second anchoring member situated about vertically relative to the ground-engaging member of the second anchoring member and about horizontally relative to the ground, positioning the second anchoring member in a manner that a bottom portion of the second leg is disposed inside the brace member of the second anchoring member; with the bottom portion of the first leg of the ladder disposed inside the brace member of the first anchoring member, lifting the first leg of the ladder above ground and pivoting the ground-engaging member of the first anchoring member in a manner that the ground-engaging member of the first anchoring member positions about vertically relative to the ground; engaging the ground-engaging member of the first anchoring member with the ground; with the bottom portion of the second leg of the ladder disposed inside the brace member of the second anchoring member, lifting the second leg of the ladder above ground and pivoting the ground-engaging member of the second anchoring member in a manner that the ground-engaging member of the second anchoring member positions about vertically relative to the ground; engaging the ground-engaging member of the second anchoring member with the ground; and pivoting the top end of the ladder from a position on the ground toward the standing object.

These and other features, aspects and advantages of the present invention will become better understood with reference to the following drawings, description and claims.

BRIEF DESCRIPTION OF THE DRAWINGS

FIG. 3 is a bottom perspective view of a channel bracket showing a threaded attachment of a corkscrew shaped post to the bottom of the channel bracket according to an embodiment of the present invention;

FIG. 3A is a bottom perspective view of a channel bracket showing a welded attachment of a corkscrew shaped post to the bottom of the channel bracket according to an embodiment of the present invention;

FIG. 5 is a front perspective view of a rectangular-shaped brace member having a notched right sidewall according to an embodiment of the present invention;

FIG. 5A is a front perspective view of a brace member with a notched right sidewall attached to a channel bracket according to an embodiment of the present invention;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, an embodiment of the present invention generally relates to a device for supporting a ladder and maintaining it in a stable position as it is being set up against a tree or a building to be used, for example, to paint a wall. More typically, however, the device is useful for anchoring a ladder used by hunter to climb onto as it lean against a tree by creating a stable pivot point on the ground. Ladders used by hunters are typically long and contain a platform on the top of the ladder where a hunter is positioned as he or she waits for an animal such as a deer to appear. This makes hunting ladders cumbersome to erect and lean against a tree from a flat position on the ground.

Figure 1A:
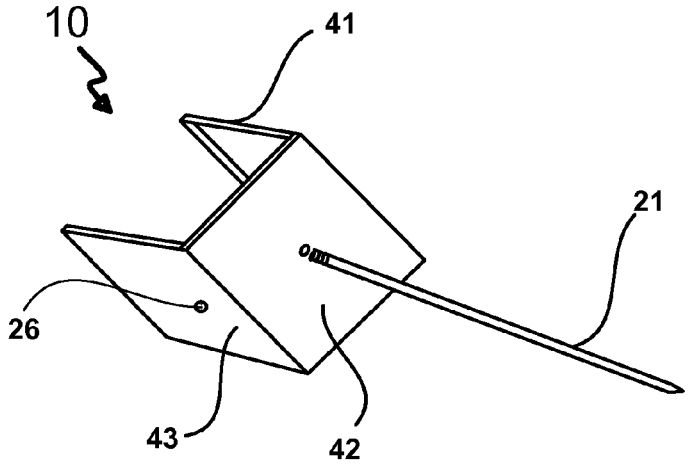
FIG. 1A is a bottom perspective view of a channel bracket showing a threaded attachment of a straight post to the bottom of the channel bracket according to an embodiment of the present invention.
Figure 2:
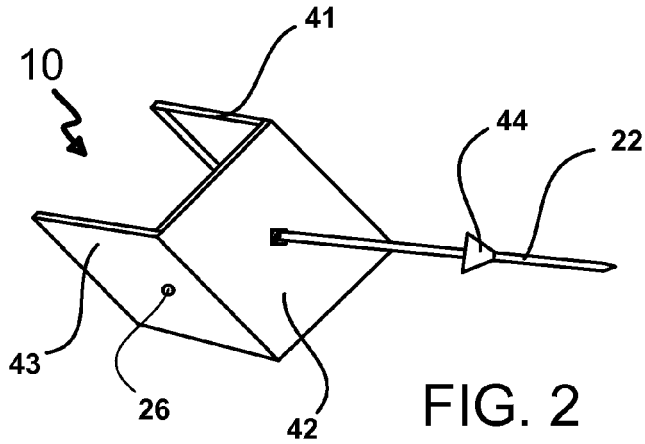
FIG. 2 is a bottom perspective view of a channel bracket showing a welded attachment of a straight post containing a securing attachment to the bottom of the channel bracket according to an embodiment of the present invention.
Figure 1:
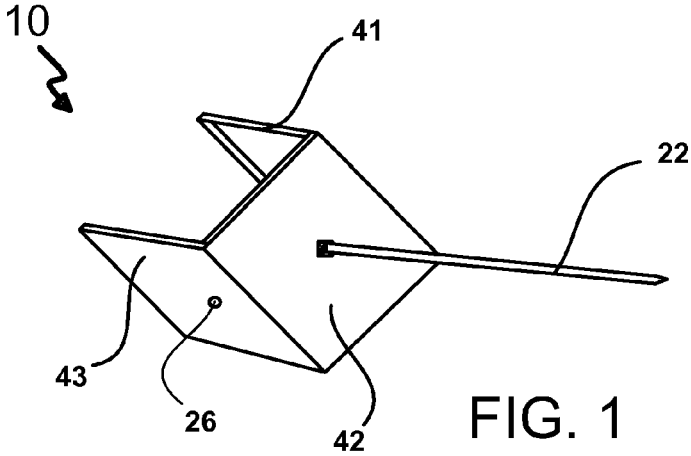
FIG. 1 is a bottom perspective view of a channel bracket showing a welded attachment of a straight post to the bottom of the channel bracket according to an embodiment of the present invention.
Figure 4:
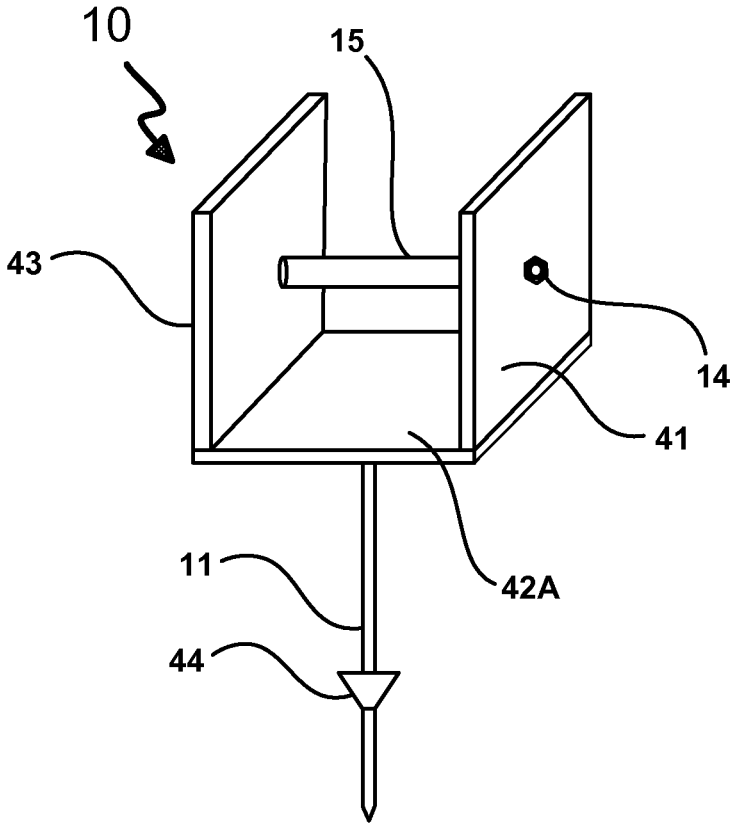
FIG. 4 is a front perspective view of a channel bracket showing a pivot rod attached to the channel bracket used for supporting a brace member and the legs of a ladder according to an embodiment of the present invention.
Figure 5B:
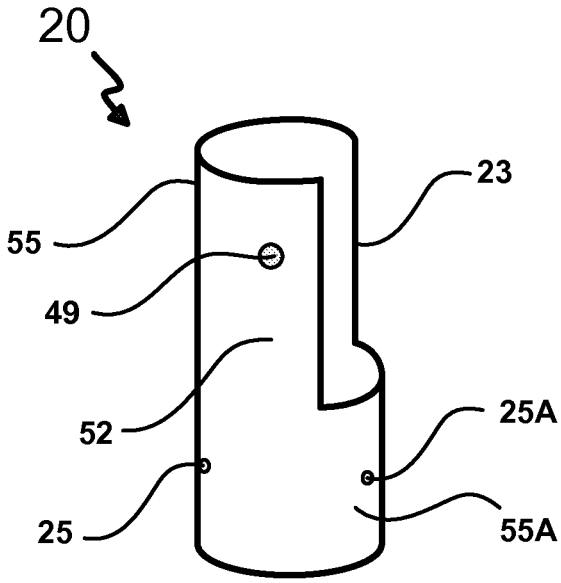
FIG. 5B is a front perspective view of a cylindrical-shaped brace member having a notched right sidewall according to an embodiment of the present invention.

The device is depicted in FIGS. 1-10. Referring to FIG. 1, there is shown a channel bracket 10 having a first side 43, a second side 41 a bottom underside 42 and a bottom oversurface 42A. Openings 26 in the first and second sidewalls are used for inserting a pivot rod 15. A ground-engaging member 11 is attached to the bottom underside 42 of the channel bracket 10. The ground-engaging member 11 may be a straight post 22 welded to the bottom underside 42 or threaded 21 onto it. The post is inserted into the ground 33 to help secure and stabilize the device. In another embodiment shown in FIG. 2, a securing attachment 44 is welded to or manufactured as part of straight post 22 to provide additional stability to the device. The ground-engaging member 11 may have a corkscrew shape and threaded 19 onto the bottom underside 42 of the channel bracket 10 or welded 19A onto it as shown in FIG. 3. A pivot rod 15 traverses between the first side 43 and second side 41 of the channel bracket 10 and is secured to the sides with nut 14 on each side as shown in FIG. 4. Rectangular-shaped brace member 20 shown in FIG. 5 comprises a first sidewall 55, a second sidewall 55A, a front wall 52 and a back wall 23 but has an open bottom. The first sidewall contains aperture 25 and the second sidewall contains aperture 25A. The brace member 20 is installed onto the channel bracket 10 thereby forming the anchoring member 30 as illustrated in FIG. 5A. A cylindrical-shaped brace member 20 shown in FIG. 5B representing another embodiment of the present invention. To install the brace member 20 onto the channel bracket 10, the pivot rod 15 is threaded through openings 26 in the first and second sidewalls of the channel bracket 10 and the apertures 25 in the first sidewall and the second sidewall 25A of the brace member 20. The brace member 20 is configured to pivot around the pivot rod 15 from the front side to the back side spanning at least about 180 degrees while the channel bracket 10 is anchored to the ground 33 in a stationary position. The pivot rod 15 supports the brace member 20 as it pivots from the front to the back as it is set up against a tree 37 or a wall. The front wall 52 and back wall 23 of brace member 20 contain apertures 49 used for passing through a strap 35 for further stabilizing a ladder 70. The second sidewall of the brace member 55A may be notched, i.e., shorter, compared to the brace member first sidewall 55, as may be seen in FIGS. 5 and 5A. In an embodiment of the present invention, a notched sidewall may have about half the length of the front wall 52 or a non-notched sidewall. A notched sidewall facilitates placement and removal of the ladder legs from the brace member in the course of setting up the ladder and facilitates supporting a ladder with a low rung.

Figure 8:
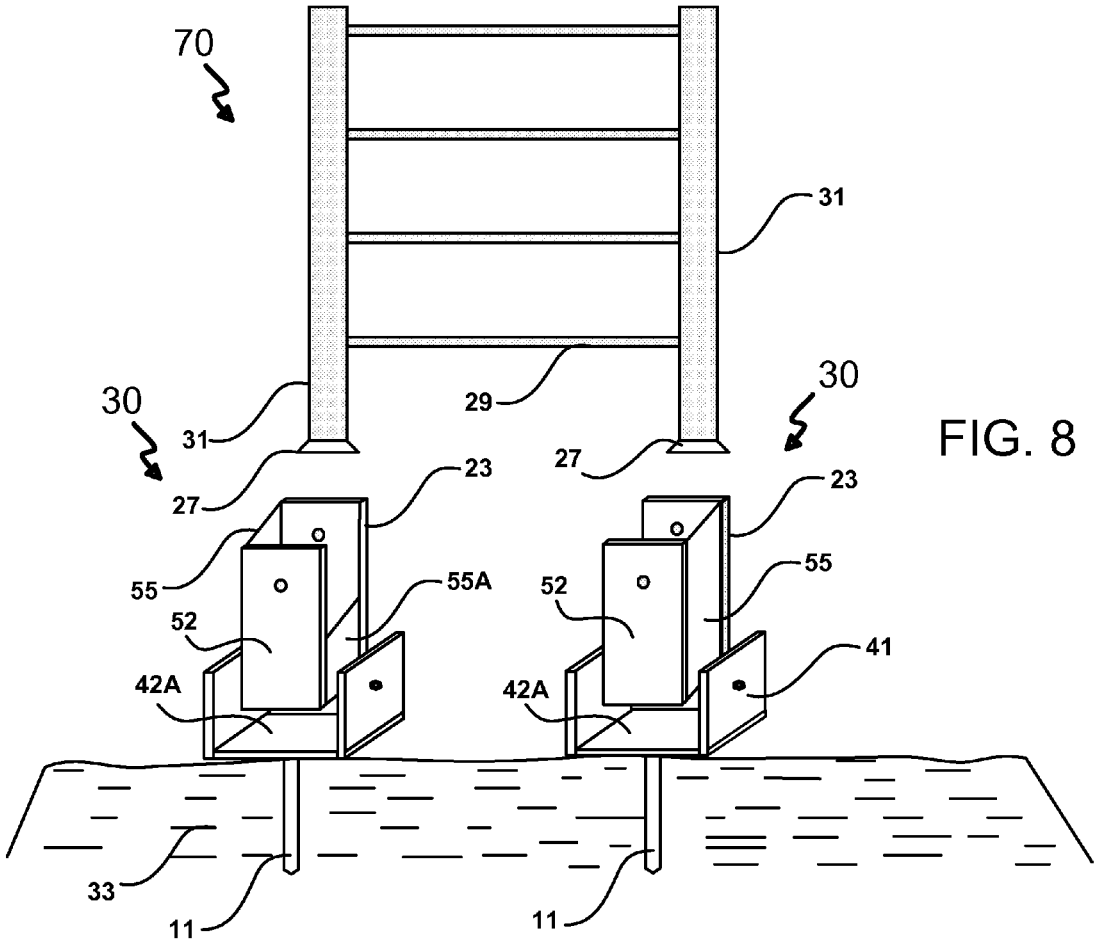
FIG. 8 is an exploded front perspective view of two anchoring members engaged with the ground and disposed side by side and a ladder having legs adapted for placement inside the brace members of the anchoring members according to an embodiment of the present invention.
Figure 9:
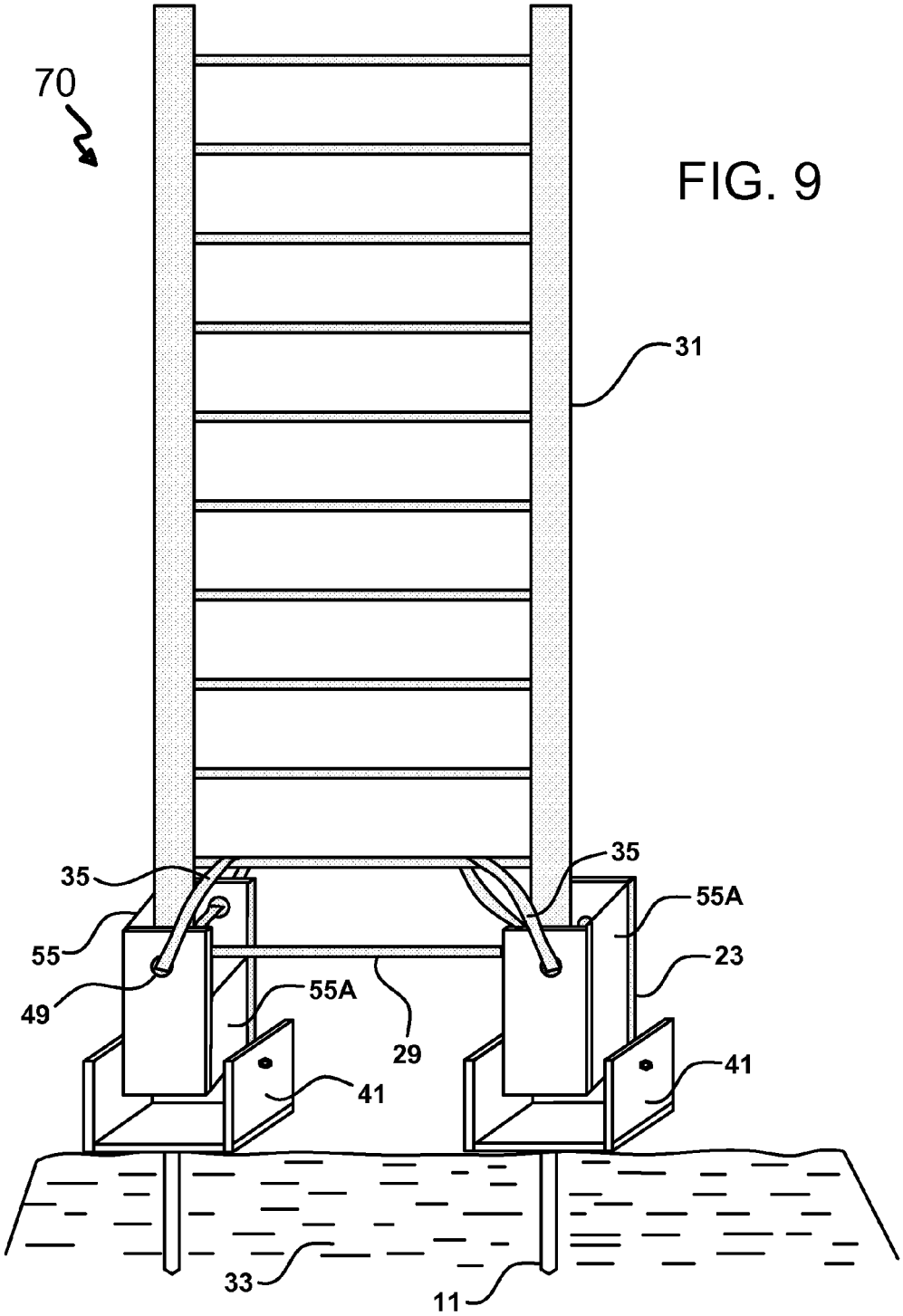
FIG. 9 is a front perspective view of the two anchoring members engaged with the ground and disposed side by side with the ladder legs placed into the brace members of the two anchoring member respectively and showing straps fastening a rung of the ladder to the brace members according to an embodiment of the present invention.

FIG. 8 shows two anchoring members 30 anchored to the ground 33 side by side with ladder 70 shown having a first rung 29, legs 31 and leg bottoms 27. In this context, the first rung is the lowest or bottom rung of the ladder. With this configuration, the legs 31 of the ladder 70 are placed inside the brace members 20 of the anchoring members 30. Another embodiment for enhancing the stability of the ladder 70 is the use of straps 35 threaded through holes 49 and wrapping around a ladder rung as FIG. 9 shows.

Figure 10:
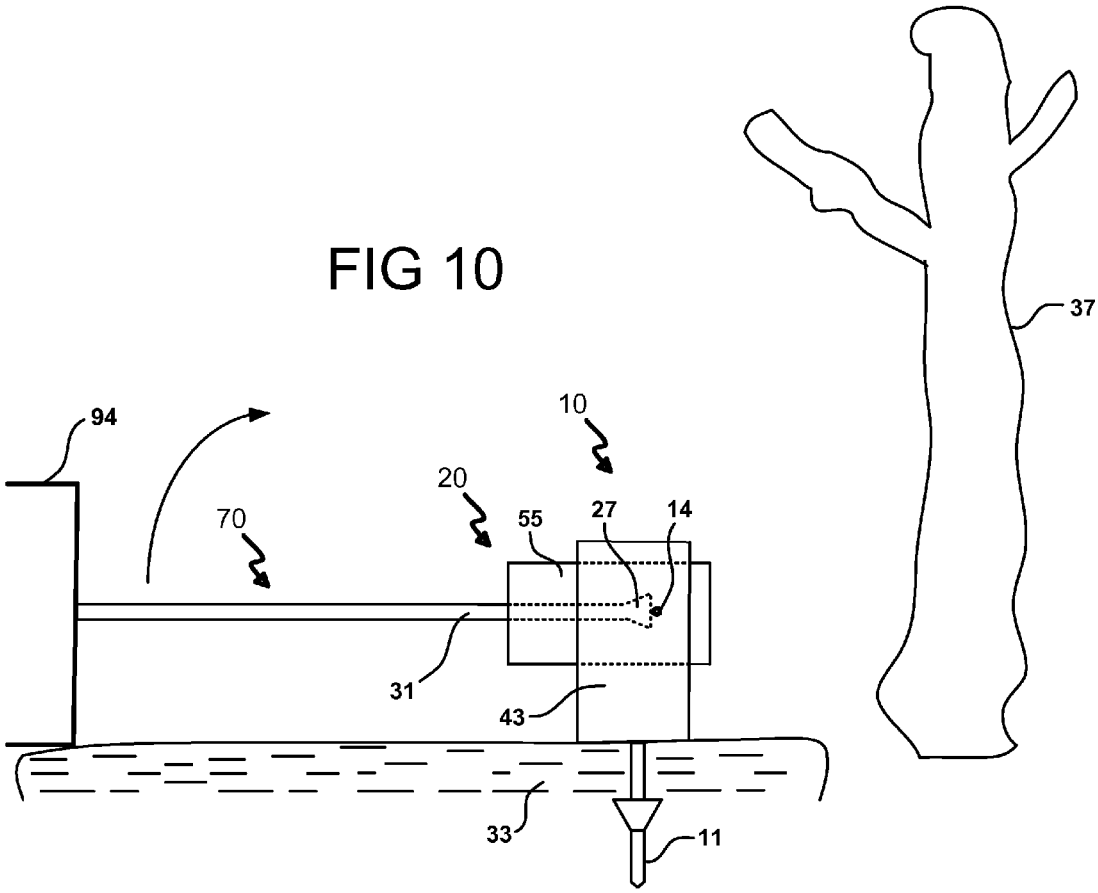
FIG. 10 is an illustration of a ladder in a flat position on the ground with a ladder leg placed inside a brace member of an anchoring member that is anchored to the ground according to an embodiment of the present invention.
Figure 10A:
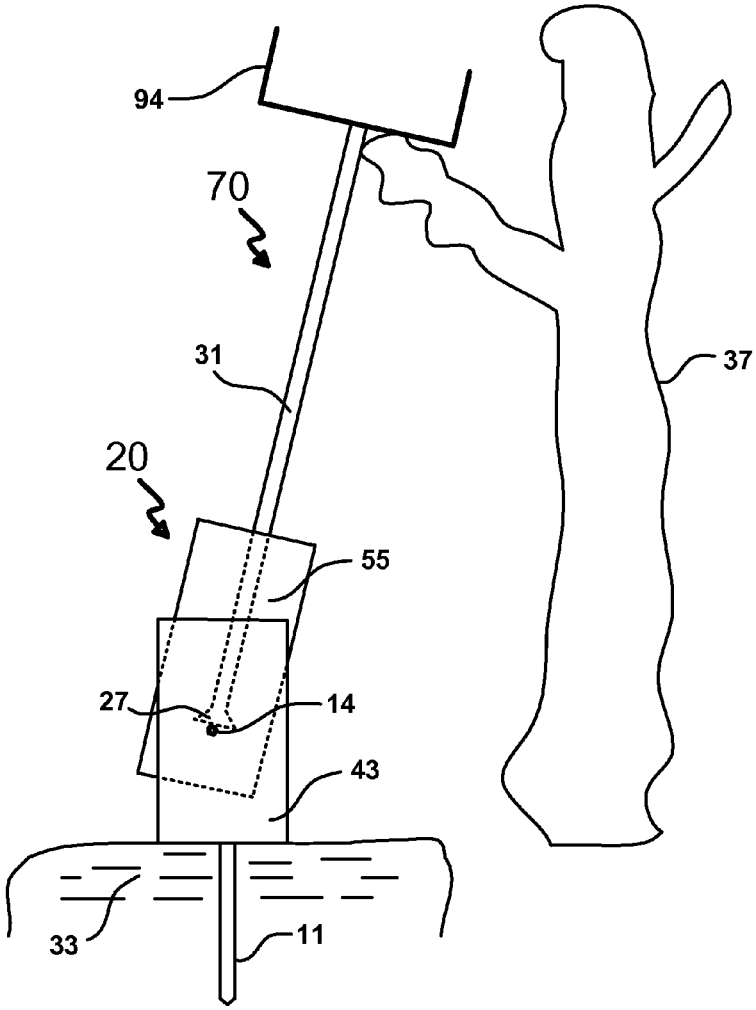
FIG. 10A is an illustration of a ladder set up against a tree with a ladder leg placed inside a brace member of an anchoring member that is anchored to the ground with the brace member tipping over toward the tree such that the ladder is leaned against the tree according to an embodiment of the present invention.

FIGS. 10 and 10A illustrate a configuration for setting up a ladder 70 against a tree 37. In FIG. 10, the ladder 70 having a platform stand 94 and leg 31 is laid flat on the ground 33 having the leg bottom placed inside brace member 20 that is pivotally attached to the channel bracket 10 such that it may pivot from a front position to a back position. The ladder leg 31 is supported by the pivot rod 15 that is not shown in FIG. 10 but which extends from tightening nut 14 and is disposed inside the channel bracket. In this context, the front position of the channel bracket 10 is away from the tree 37, while the back position of the channel bracket 10 is located between the brace member 20 and the tree. The channel bracket 10 is affixed to the ground 33 by post 11. With the brace member 20 pivoted toward the front and away from the tree 37, the ladder 70 may be raised in the direction of the arrow in FIG. 10 and leaned against the tree 37 as shown in FIG. 10A.

In order to set up the ladder, a location must first be selected for the ladder legs. With the legs positioned at about the desired spot, one leg is lifted slightly, the brace member of the first anchoring member is pivoted to receive the slightly lifted leg and then the first anchoring member is affixed to the ground. This procedure is repeated for the second ladder leg. Once the legs are disposed inside their respective brace members and with the anchoring members secured to the ground, the top of the ladder may be pivoted from a flat position on the ground to a position of leaning against the tree.

Figure 6A:
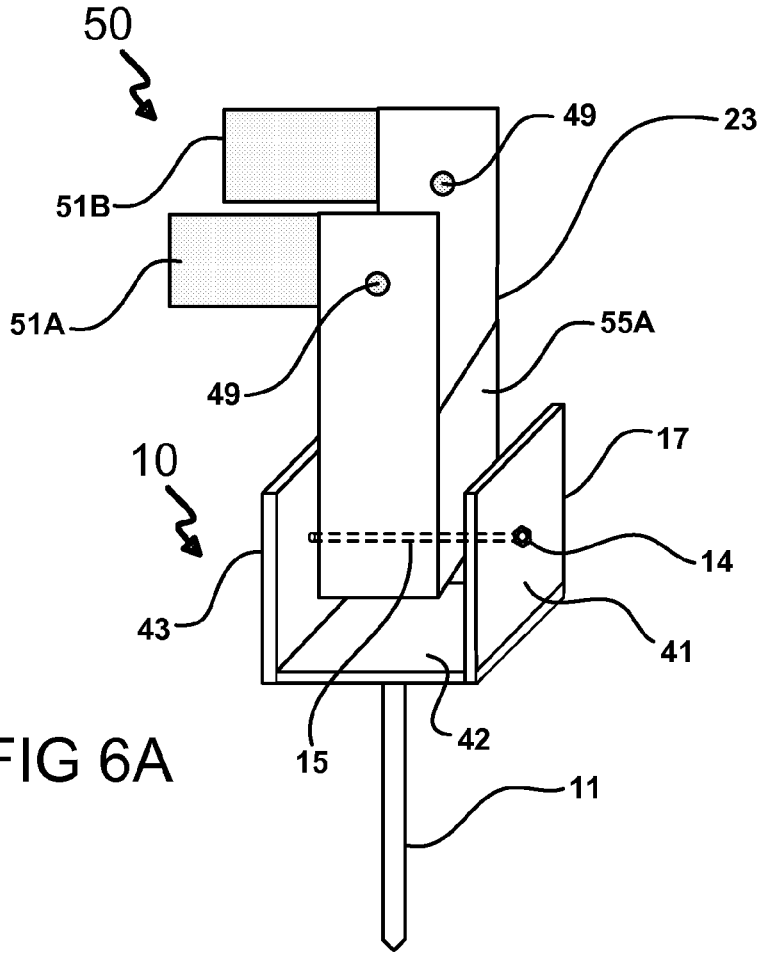
FIG. 6A is a front perspective view of a brace member comprising lateral attachment tabs and having notched left and right sidewalls; the brace member is attached to a channel bracket according to an embodiment of the present invention.
Figure 6:
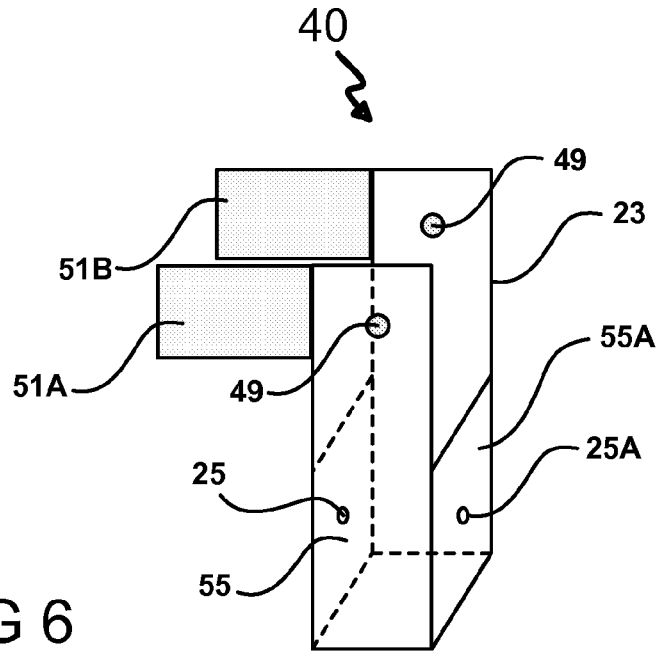
FIG. 6 is a front perspective view of a brace member comprising lateral attachment tabs and having notched left and right sidewalls according to an embodiment of the present invention.
Figure 7:
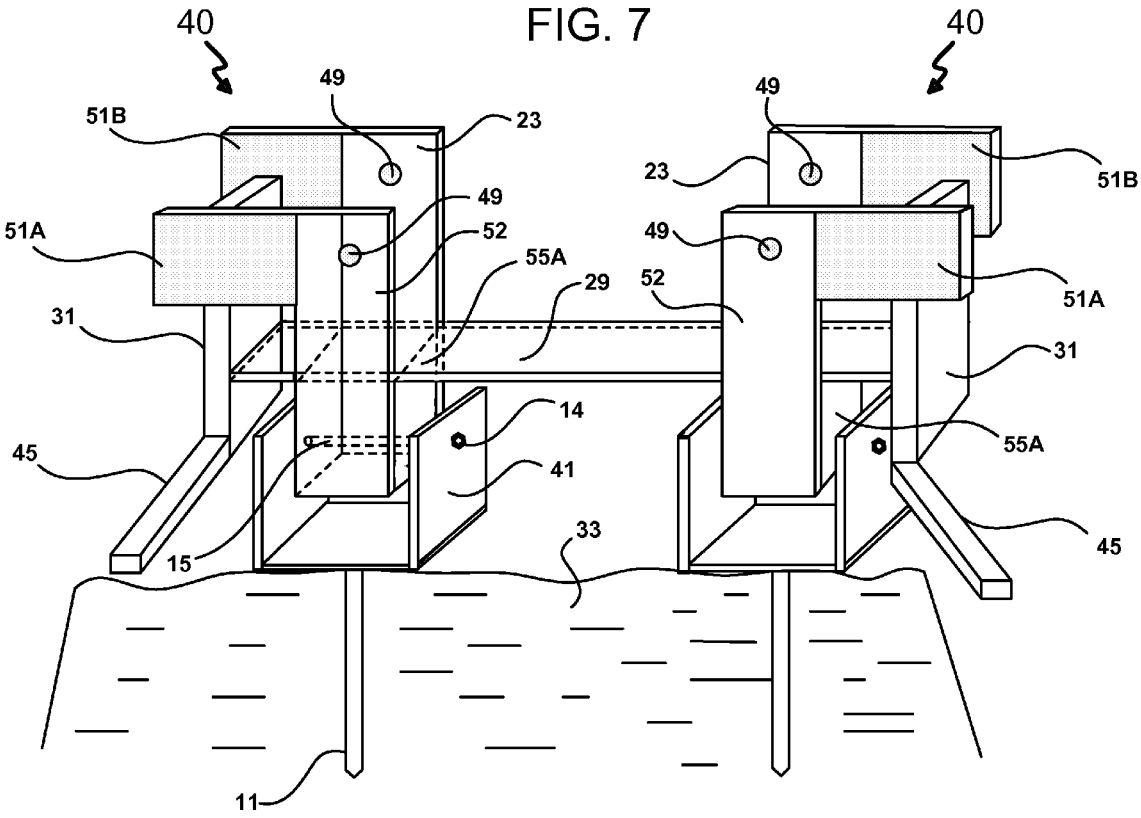
FIG. 7 is a front perspective view of a first anchoring member and a second anchoring member of the device engaged with the ground and disposed side by side with the ladder's low rung placed in the brace members of the first anchoring member and the second anchoring member; the brace members have notched left and right sidewalls according to an embodiment of the present invention.
Figure 7A:
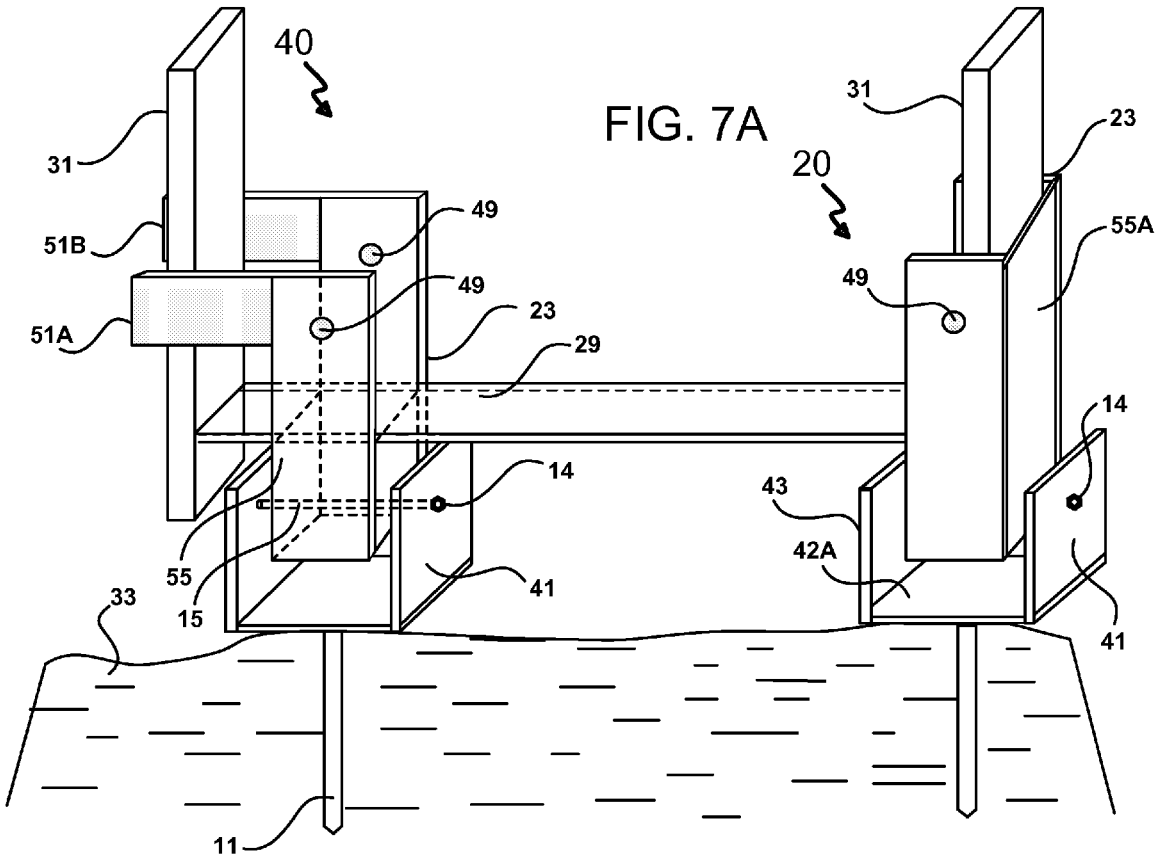
FIG. 7A is a front perspective view of a first anchoring member and the second anchoring member of the device engaged with the ground and disposed side by side with the ladder's low rung placed in the brace member of the first anchoring member having notched left and right sidewalls and the second vertical side of the ladder is placed in the brace member of the second anchoring member having a notched left side and an un-notched right side according to an embodiment of the present invention.

The embodiments presented in FIGS. 1-5, and 8-10 relate to standard hunting ladders that, for the most part, have straight legs that may be securely positioned inside a brace member of the device. In another embodiment of the present invention, the brace member is configured to brace a first rung of a ladder rather than its legs. This type of situation may arise in case of, as examples, a ladder having a low rung and its legs are too short to be supported by the brace member in a stable manner, a ladder having kick out legs that do not fit inside the brace member or, due to ground irregularities, the anchoring members cannot be positioned in the desired location and be spaced properly to accommodate the legs of a ladder. FIG. 6 shows a configuration of a brace member 40 having a lateral extension tab 51A attached to an upper portion of the front wall 52 and extension tab 51B attached to an upper portion of the back wall 23 of brace member 40. With this brace member 40 configuration, both the first sidewall 55 and the second sidewall 55A are notched. FIG. 6A illustrates the anchoring member configuration 50 resulting from attaching brace member 40 to a corresponding channel bracket 10. FIG. 7 shows ladder legs 31 having a kick-out extension 45. With this configuration, the lowest rung 29 is placed on the notched first sidewall 55 and notched second sidewall 55A of both anchoring members 50. Lateral extension tab 51A attached to an upper portion of the brace member 40 front wall 52 and lateral extension tab 51B attached to an upper portion of the brace member 40 back wall 23 provide additional support for ladder legs 31. FIG. 7A shows an embodiment in which one of the anchoring members comprises a brace member 20 without lateral extension tabs while the other anchoring member comprises a brace member 40 having two lateral extension tabs 51A and 51B. This arrangement may be used when ground irregularities do not allow spacing the two anchoring members to fit the ladder legs.

The components of the ladder anchor may be manufactured of any suitable material including but not limited to metal, plastic, wood or combinations thereof.

It should be understood, of course, that the foregoing relates to exemplary embodiments of the invention and that modifications may be made without departing from the spirit and scope of the invention.

I claim:

1. A device for anchoring a ladder onto a ground surface comprising a first anchoring member having a front side and a back side and a second anchoring member having a front side and a back side, said ladder having a first leg and a second leg, said each of the first and second anchoring member comprising:

a channel bracket having a bottom, a first sidewall and a second sidewall, said bottom having an undersurface and an oversurface;

a ground-engaging member having a first end, a second end and a length portion, said first end of said ground-engaging member being attached to the bottom of said channel bracket, said second end and said length portion being adapted for engagement with the ground;

a pivot rod having a first end and a second end, said first end being affixed to a spot on the first sidewall of the channel bracket and a second end being affixed to the second sidewall of the channel bracket, said pivot rod traversing an inside portion of the channel bracket from the first sidewall of the channel bracket to the second sidewall of the channel bracket; and a brace member having a first sidewall, a second sidewall, an open bottom, a front wall and a back wall, said pivot rod being threaded though an opening in the first sidewall and an opening in the second sidewall in a manner that said pivot rod supports the brace member and in a manner that said brace member is adapted for pivoting around the pivot rod in a direction from the front side of the anchoring member toward the back side of the anchoring member and vice versa, said ground-engaging member of the first anchoring member and the around-engaging member of the second anchoring member each comprises a straight post adapted for insertion into the ground, wherein the device for anchoring a ladder onto a ground surface, in a position of the ground-engaging member of the first anchoring member being engaged with the ground, the brace member of the first anchoring member is adapted for containing the first leg of the ladder and further adapted for pivoting from at least a position wherein the front wall of the brace member is substantially parallel with the ground at the front side of the first anchoring member to a position wherein the back wall of the brace member of the first anchoring member is substantially parallel with the ground at the backside of the first anchoring member, said first leg of the ladder being placed onto the pivot rod of the first anchoring member, said pivot rod of the first anchoring member is guiding and supporting the first leg of the ladder in the course of said first ladder leg moving from the position wherein the front wall of the brace member is substantially parallel with the ground at the front side of the first anchoring member to the position wherein the back wall of the brace member of the first anchoring member is substantially parallel with the ground at the backside of the first anchoring member.

2. The device of claim 1 wherein, in a position of the ground-engaging member of the second anchoring member being engaged with the ground, the brace member of the second anchoring member is adapted for containing the second leg of the ladder and further adapted for pivoting from at least a position wherein the front wall of the brace member is substantially parallel with the ground at the front side of the second anchoring member to a position wherein the back wall of the brace member of the second anchoring member is substantially parallel with the ground at the backside of the second anchoring member, said second leg of the ladder being placed onto the pivot rod of the second anchoring member, said pivot rod of the second anchoring member guiding and supporting the second leg of the ladder in the course of said second ladder leg moving from the position wherein the front wall of the brace member is substantially parallel with the ground at the front side of the second anchoring member to the position wherein the back wall of the brace member of the second anchoring member is substantially parallel with the around at the backside of the second anchoring member.

3. A device for anchoring a ladder onto a ground surface comprising a first anchoring member having a front side and a back side and a second anchoring member having a front side and a back side, said ladder having a first rung, said ladder also having a first vertical side attached to a side of the first rung and a second vertical side attached to an opposite side of the first rung, said each of the first and second anchoring member comprising:

a channel bracket having a bottom, a first side and a second side, said bottom having an undersurface and an oversurface;

a ground-engaging member having a first end, a second end and a length portion, said first end of said ground-engaging member being attached to the bottom of said channel bracket, said second end and said length portion being adapted for engagement with the ground;

a pivot rod having a first end and a second end, said first end being affixed to a spot on the first side of the channel bracket and the second end being affixed to the second side of the channel bracket;

a brace member having a first sidewall, a second sidewall, an open bottom, a front wall and a back wall, said pivot rod being threaded though an opening in the first sidewall and an opening in the second sidewall in a manner that said pivot rod supports the brace member and in a manner that said brace member is adapted for pivoting around the pivot rod in a direction from the front side of the anchoring member toward the back side of the anchoring member and vice versa, said brace member being adapted for supporting the first rung of a ladder;

a lateral extension tab attached to an upper portion of the brace member front wall; and a lateral extension tab attached to an upper portion of the brace member back wall.

4. The device of claim 3, wherein the first sidewall of the brace member is notched and the second sidewall of the brace member is notched.

5. The device of claim 3, wherein the first rung is adapted to fit inside the brace member of the first anchoring member and the second anchoring member.

6. The device of claim 3, wherein the first vertical side of the ladder is adapted to fit between the lateral extension tab attached to the upper portion of the front wall of the brace member of the first anchoring member and the lateral extension tab attached to the upper portion of the back wall of the brace member of the first anchoring member.

7. The device of claim 3, wherein the second vertical side of the ladder is further adapted to fit between the lateral extension tab attached to the upper portion of the front wall of the brace member of the second anchoring member and the lateral extension tab attached to the upper portion of the back wall of the brace member of the first anchoring member.

* * * * *